United States Patent [19]

Eller

[11] 4,005,553

[45] Feb. 1, 1977

[54] CLAMPING DEVICE FOR USE IN SHARPENING SHEARS AND THE LIKE

[76] Inventor: Millard H. Eller, P.O. Box 111, Granville, Mass. 01034

[22] Filed: July 11, 1975

[21] Appl. No.: 594,958

[52] U.S. Cl. ..... 51/218 R

[51] Int. Cl.[2] ..... B24B 3/52

[58] Field of Search ..... 51/218 R, 218 A, 218 P

[56] References Cited

UNITED STATES PATENTS

| | | | |
|---|---|---|---|
| 359,533 | 3/1887 | Convers | 51/218 A |
| 941,272 | 11/1909 | Powell | 51/218 A |
| 980,654 | 1/1911 | Mason | 51/218 A |
| 1,659,257 | 2/1928 | Giampeter | 51/218 A |
| 3,574,268 | 4/1971 | Buse | 51/218 A |

FOREIGN PATENTS OR APPLICATIONS

| | | | |
|---|---|---|---|
| 73,487 | 10/1916 | Switzerland | 51/218 A |

*Primary Examiner*—Harold D. Whitehead
*Attorney, Agent, or Firm*—Bacon & Thomas

[57] ABSTRACT

A clamping device for use in sharpening shears and the like with a grinding wheel wherein the shear blade is adjustably and rigidly clamped onto a counterbalanced support member that is secured to a base member for free pivotal movement with respect thereto. The degree of free pivotal movement of the support member is adjustable such that the force of gravity permits the counterbalanced support member to assume any desired grinding angle.

6 Claims, 4 Drawing Figures

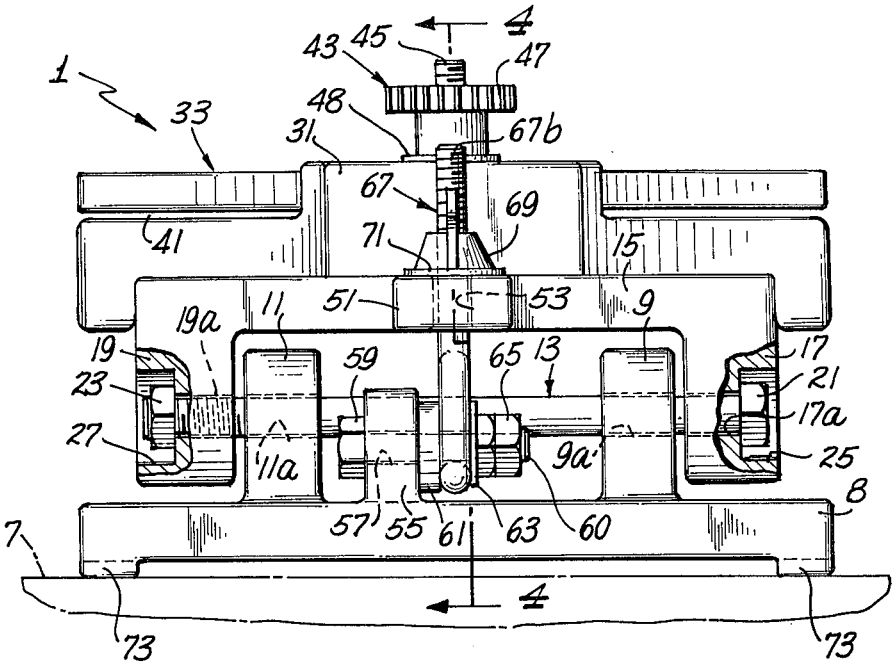
Fig. 3.
Fig. 4.
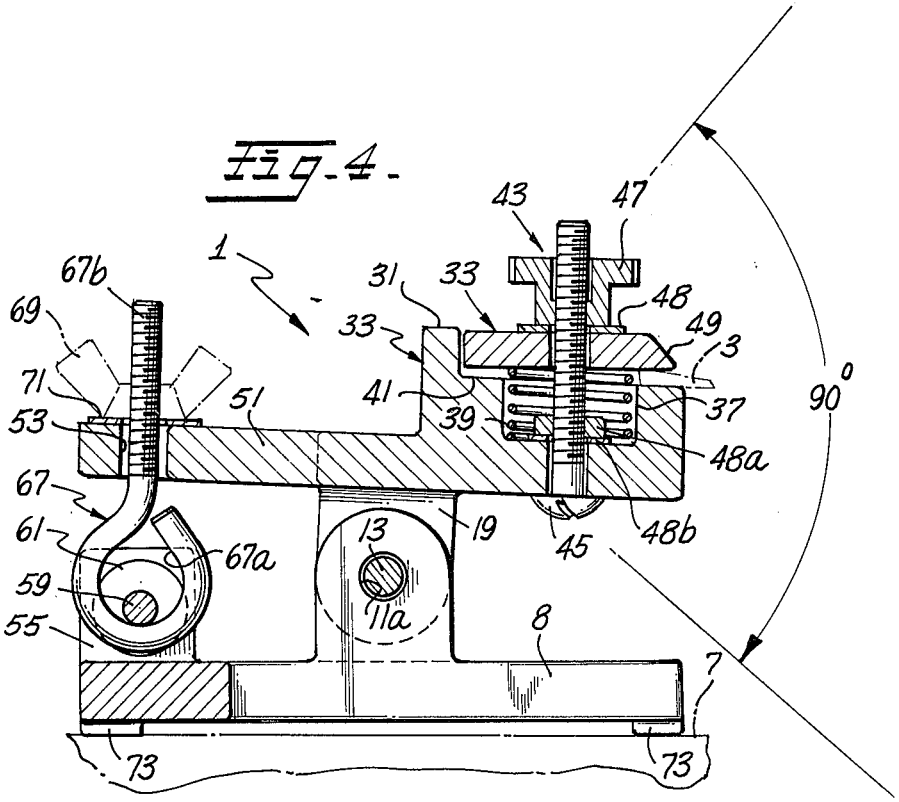

CLAMPING DEVICE FOR USE IN SHARPENING SHEARS AND THE LIKE

BACKGROUND OF THE INVENTION

1. Field of the Invention

The present invention relates generally to work holders for securing a tool that is being worked upon by a machine or similar such device. More particularly, the present invention is directed to a device for clamping the blade of a shear or similar tool for sharpening by means of a grinding or abrasive wheel. Such clamping devices are normally provided with certain adjustability features to permit the adaptation of the device to the specific structural configuration and required grinding angle of the shear blade being sharpened.

2. Description of the Prior Art

The prior art is replete with various forms of work holders or clamping devices whereby knife blades, sharp tools or shear blades may be secured for sharpening by means of a grinding or abrasive wheel. These devices manifest different forms of clamping arrangements for securing the blade to be sharpened to the general body of the device itself, and also various forms of provisions for adjusting the angular disposition of the blade with respect to the grinding wheel for achieving the optimum grinding angle.

Such prior art devices may generally be classified into two broad groups. First, there are those independent, manually held and guided clamping devices which are not structurally associated or physically integral with the grinding wheel apparatus. Secondly, there are those clamping devices which are integrally or structurally associated with the grinding wheel apparatus such that their manner of use is limited specifically to the configuration and mounting arrangement of the grinding wheels with which they are associated.

The main problems characteristic of work holders or clamping devices for securing a shear or similar blade to be sharpened by a grinding wheel are based primarily upon the manner in which the blade is clamped onto the device and the manner in which the grinding angle of the blade is adjusted with respect to the position of the grinding wheel in accordance with the blade's individual structure. There have been many prior art attempts to provide for a clamping device whereby the blade to be sharpened can be easily and rigidly secured to the device without loosening or twisting of either the blade or clamp mechanism during the grinding operation. In addition, such known clamping devices have also assumed various configurations in attempts to adapt them to a variety of individual blade shapes. These prior art clamping devices, be they independent or structurally associated with a grinding apparatus, normally are only operable with very basic and simple shear blade configurations and do not permit the effective clamping and sharpening of more complex shear blade structures such as those having a serrated or "pinking" edge configuration. Such prior art clamping devices further do not permit a very rigid and secure clamping of the blade with the usual result being that the blade tends to move or twist, thereby destroying the precise grinding angle required for proper sharpening.

The critical problem of adjusting the precise required angle of the clamped blade with respect to the grinding wheel so that effective sharpening can be achieved is difficult to solve. Heretofore known devices manifest various forms of adjustment structures for achieving the desired grinding angle. However, the majority of these solutions are cumbersome, complex and expensive to produce. These devices are also almost invariably an integral part of the overall grinding apparatus since it has heretofore been difficult if not impossible to provide for an independent, manually operated clamping device which is both simple in structure and capable of precise grinding angle adjustment.

SUMMARY OF THE INVENTION

The clamping device of the present invention serves to overcome all the disadvantages and deficiencies inherent in the aforementioned known prior art devices. This is accomplished by providing for an improved clamping device which is in the form of an independent, manually held and operated unit that can be utilized with almost any known grinding or sharpening wheel apparatus. The clamping device of the instant invention includes a support member that is pivotally secured to a base member for free movement with respect thereto. The forward portion of the support member is structurally counterbalanced to pivot downwardly towards the grinding wheel. The rear portion of the support member is connected to the base member through an adjustment mechanism which permits the precise setting of the degree of free pivotal movement by the counterbalanced support member under the force of gravity, thereby setting the precise grinding angle. The shear blade is clamped upon the forward portion of the support member by a trapezoidal-shaped clamping plate which has one parallel side disposed adjacent an abutment formed in the support member to prevent twisting of the blade and subsequent loosening of the clamping plate due to the torque imposed upon the blade by the grinding wheel. The clamping plate is spring-biased away from the support member and pressed thereto by an adjustment mechanism which applies the clamping force on the blade to be sharpened. The forward parallel side of the clamping plate is provided with an edge forming an acute angle with the horizontal plane of the plate, thereby permitting clearance room for the grinding wheel during extreme angular adjustments of the pivotal support member.

It is therefore an object of the present invention to provide for a manually operated work holder or clamping device for securing a shear blade or the like at any given desired angle for sharpening by an independent grinding wheel.

It is another object of the present invention to provide for a clamping device which is capable of clamping a large variety of shear or similar blades of any given configuration for sharpening by a grinding wheel.

It is still another object of the present invention to provide for a clamping device for shears and the like which is extremely simple in structure and economical to manufacture.

It is yet another object of the present invention to provide for a clamping device which permits a rigid and secure clamping of a blade to be sharpened and the precise angular positioning of the blade with respect to the grinding wheel.

It is yet a further object of the present invention to provide for a clamping device wherein the precise grinding angle is achieved by a simple adjustment in conjunction with the force of gravity.

It is still yet another object of the present invention to provide for an independent, manually operated clamping device which can be adapted for use with a variety of grinding or sharpening wheel apparatus.

It is still yet a further object of the present invention to provide for a clamping device for shears and the like wherein the shear blade may be inserted and clamped within the device at any desired position without the possibility of the clamping mechanism being loosened by the torque imposed upon the blade during the grinding operation.

These and other objects of the present invention will be apparent from the following description and appended claims, reference being made to the accompanying drawings forming a part of this specification wherein like reference drawings designate corresponding parts in the several views.

BRIEF DESCRIPTION OF THE DRAWINGS

FIG. 3 is a rear elevational view, partly in section; and

FIG. 4 is a vertical sectional view, taken along the staggered line 4—4 of FIG. 3.

BRIEF DESCRIPTION OF THE PREFERRED EMBODIMENT

Figure 1:
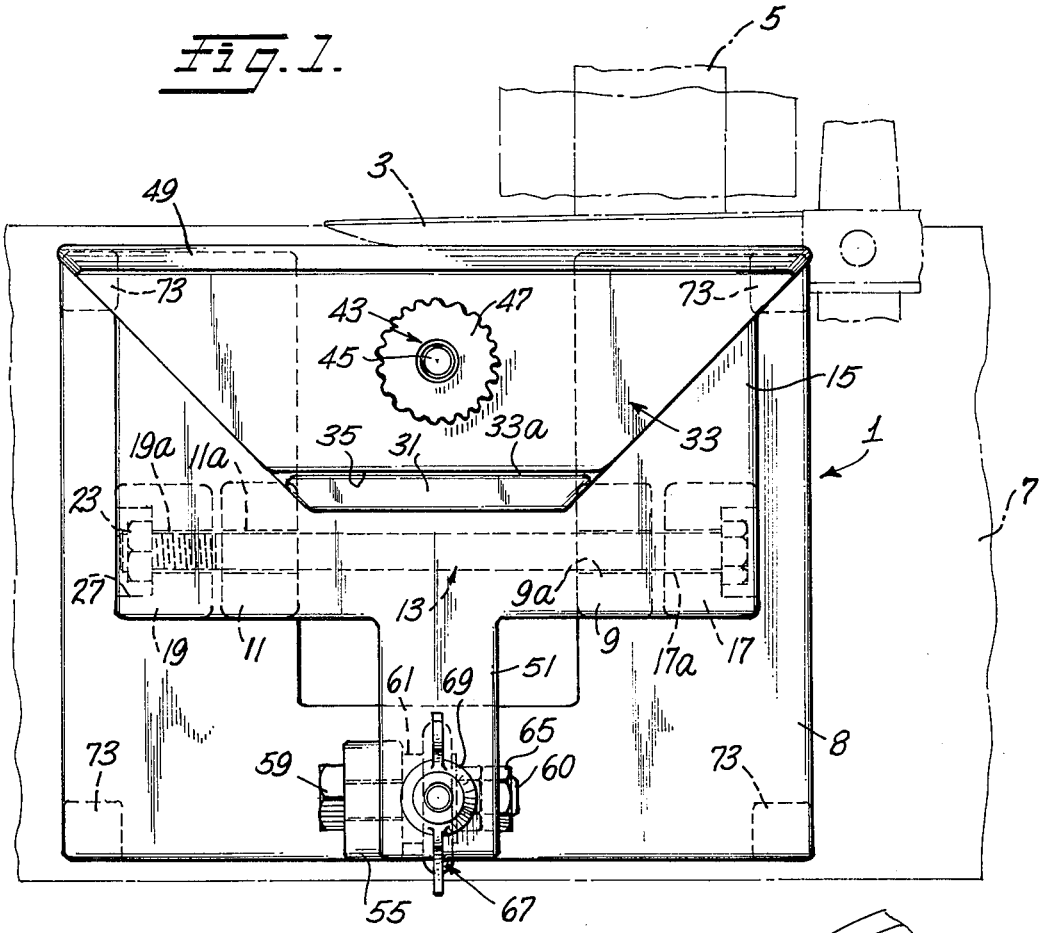
FIG. 1 is a plan view of the clamping device of the present invention.
Figure 2:
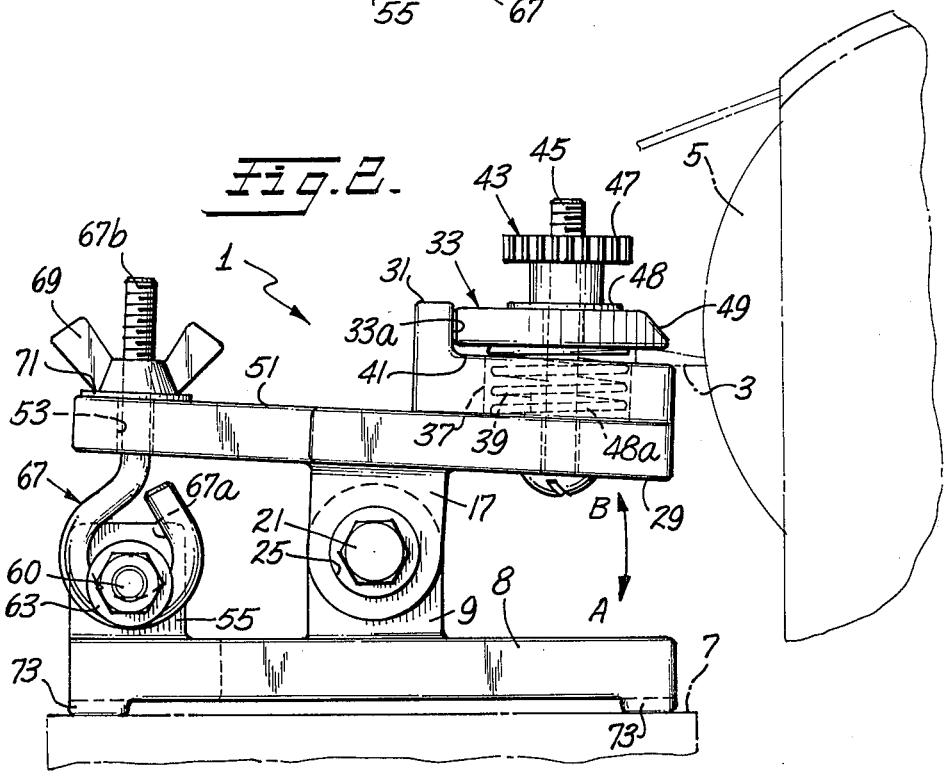
FIG. 2 is a side elevational view of the clamping device of FIG. 1, as viewed from the right thereof.

As depicted in FIGS. 1 and 2, the clamping device 1 of the present invention is an independent, manually held and operated unit that is capable of rigidly clamping a shear blade 3 for sharpening by means of any conventional or well known grinding wheel 5. Clamping device 1 may be supported for use by any suitable planar surface 7 in order that blade 3 may be positioned at the precise grinding angle with respect to grinding wheel 5.

More particularly, clamping device 1 includes a base member 8 provided with upstanding flanges 9 and 11, as indicated in FIG. 3, having bores 9*a* and 11*a* formed therethrough, respectively. Pivotally secured to base member 8 by means of bolt 13 journalled within bores 9*a* and 11*a* is a support member 15 provided with downwardly depending flanges 17 and 19. Bores 17*a* and 19*a* provided through flanges 17 and 19, respectively, are aligned with bores 9*a* and 11*a* to receive the journalled ends of bolt 13 which is secured in place by means of its head portion 21 and threaded nut 23. As shown in FIG. 3, bolt head 21 may be enclosed within a recess 25 formed in flange 17 and threaded nut 23 may similarly be enclosed within a recess 27 formed in flange 19. By this arrangement, support member 15 is capable of free pivotal movement with respect to base member 8.

The forward portion 29 of support member 15 is structurally counterbalanced or weighted by an integral stepped flange structure 30 which is substantially trapezoidal in shape. In this manner, forward portion 29 of support member 15 will always be under the influence of gravity to pivot downwardly in the direction A as indicated in FIG. 2. Supported upon flange 31 is a clamping plate 33 having a corresponding substantially trapezoidal configuration. The shorter parallel side 33*a* of plate 33 is disposed adjacent a longitudinal stepped vertical wall section 35 of flange 31 for substantially its entire length as indicated in FIG. 1. Flange 31 is further provided with a recess 37 for receiving a coil spring 39 which serves to bias clamping plate 33 upwardly and away from upper surface 41 of flange 31. A first adjustment mechanism in the form of nut and bolt assembly 43, including threaded bolt 45, thumb-screw nut 47, washer 48, lock nut 48*a* and washer 48*b* controls the spacing between clamping plate 33 and upper surface 41 of flange 31 for clamping shear blade 3 therebetween. Because of the corresponding tradezoidal configurations of both clamping plate 33 and upper surface 41 of flange 31, an extremely strong and secure clamping action is imposed upon blade 3 when thumb-screw 47 is tightened downwardly, even if blade 3 is inserted and clamped at a non-parallel position with respect to the front edge of the clamping plate 33. The other parallel side of clamping plate 33 is provided with a forward edge 49 which forms an acute angle with the horizontal plane of plate 33, thereby permitting clearance room for grinding wheel 5 when the forward portion 29 of support member 15 is in an extreme position of downward adjustment. This is apparent from the arrangement depicted in FIG. 2.

The rear portion of support member 15 may assume the configuration of a tab 51 having an aperture 53 therethrough. A third upstanding flange 55 on base member 8 is provided with an aperture 57 through which a threaded bolt 59 is loosely journalled. The threaded portion 60 of bolt 59 is provided with washers 61 and 63 and at least one nut 65. As is evident in FIGS. 3 and 4, a second adjustment mechanism including a threaded eye bolt 67 has its eye portion 67*a* secured by bolt 59 between washers 61 and 63 in a loose pivotal manner is provided at the rear portion of support member 15. The threaded portion 67*b* of eye bolt 67 is passed through aperture 53 of tab 51 and secured in place by means of a winged lock nut 69 and associated washer 71. In this manner, the degree of free pivotal movement of forward portion 29 and support member 15 about the axis of bolt 13 in the downward direction A can be limited by adjusting the position wing nut 69 on eye bolt 67.

Base member 8 may be provided with legs 73 in the form of pads made from any suitable material such as plastic, rubber or metal, compatible with the sliding function of clamping device 1 across planar surface 7 during the sharpening operation. Further, base member 8, support member 15 and clamping plate 33 may be made from any material found suitable for the manner in which clamping device 1 is to be used. Some examples of such materials are plastics and cast light metals, i.e. aluminum, magnesium or their alloys.

The nut and bolt assembly 43 and threaded eye bolt 67 may be substituted by any other suitable adjustment mechanisms well known in the art for performing the same functions. Likewise bolt 13 and bolt 59 may be alternatively replaced by rivets, rods or the like member well known in the art for performing the same functions as these devices.

BASIC MODE OF OPERATION

When it is desired to sharpen a pair of shears or the like, the shear blade 3 is placed upon the upper forward surface 41 of flange 31 in any desired position. The clamping plate 33 is then caused to press tightly upon the rear portion of blade 3 by adjusting thumb screw 47 downwardly. The grinding angle at which the blade edge 3 assumes with respect to grinding wheel 5 is set by turning wing nut 69 in the proper direction. In this manner, counterbalanced support member 15 will pivot downwardly in direction A under the force of gravity if wing nut 69 is loosened. Alternatively, the forward portion 29 of support member 15 will pivot upwardly against the force of gravity in the direction B if wing nut 69 is tightened. Once the exact position of wing nut 69 is ascertained and set, the front portion 29 of support member 15 will always be biased downwardly in the direction A under the force of gravity, thereby causing tab 51 to press upwardly against washer 71 and wing nut 69. When the precise grinding angle has been set according to this latter procedure, the entire clamping device may then be held manually and passed across the grinding wheel 5 for contact with the shear blade 3 to be sharpened as shown in FIG. 1.

Because of the secure clamping force exerted by trapezoidal-shaped clamping plate 33 and opposed surface 41, and the disposition of edge 33*a* adjacent edge 35, the shear blade 3 will remain rigidly clamped, notwithstanding the torque imposed thereon by grinding wheel 5. Also, because of the counterbalancing of front end 29 of support member 15, the precise grinding angle will be maintained by virtue of the upward pressure of tab 51 against the preset washer 71 and wing nut 69. Finally, the independent unit structure of clamping device 1 permits the clamping of any shape blade configuration for sharpening since the user merely moves the device 1 in any direction desired with respect to a fixed grinding wheel 5. It is to be understood that the form of the invention herewith shown and described is to be taken as a preferred example of the same, and that various changes in the shape, size and arrangement of parts may be resorted to without departing from the spirit of the invention or scope of the subjoined claims.

I claim:

1. A freely movable and manipulable clamping device for use in sharpening shear blades and the like with a grinding wheel, which device comprises:

a. a base member;

b. a support member pivotally carried by the base member for free and unbiased pivotal movement with respect thereto, wherein the pivot point of the support member is disposed rearwardly of the center of gravity thereof to thereby provide a forward portion that is counterbalanced in a downward direction;

c. a clamping means carried by the forward portion of the support member, which clamping means includes:

i. a flange having a longitudinal wall section, and ii. a detachable plate having a substantially isoceles trapezoidal configuration, wherein the shorter parallel side of the plate is disposed adjacent and parallel to the longitudinal wall of the flange and the longer parallel side overlaps the blade when the latter is in a clamped position; and d. adjustable means for limiting the degree of free and unbiased pivotal movement of the support member with respect to the base member to thereby control the desired grinding angle between the blade edge and the grinding wheel.

2. The device of claim 1, wherein the plate is spring-biased in an open position and adjustably secured to the support member by means of a first threaded bolt and nut assembly for applying pressure to the blade to rigidly secure it to the support member.

3. The device of claim 1 wherein the means for adjusting the degree of free pivotal movement of the support member includes a second threaded bolt and nut assembly for applying pressure to the rear portion of the support member in a downward direction.

4. The device of claim 1 wherein the longer parallel side of the plate is provided with a forward edge that forms an acute angle with the horizontal plane of the plate, thereby providing clearance for the grinding wheel during the sharpening operation.

5. The device of claim 1 wherein the degree of free pivotal movement of the support member is an arcuate path of approximately 90°.

6. The device of claim 1 wherein the flange has a trapezoidal configuration substantially corresponding to the trapezoidal configuration of the plate.

* * * * *